US010316253B2

(12) United States Patent
Bansal et al.

(10) Patent No.: US 10,316,253 B2
(45) Date of Patent: Jun. 11, 2019

(54) CO-PRODUCTION OF ANODE AND FUEL GRADE PETROLEUM COKE IN A DELAYED COKER UNIT

(71) Applicant: KELLOGG BROWN & ROOT LLC, Houston, TX (US)

(72) Inventors: Bharat Bansal, Houston, TX (US); Suresh Pandian, Katy, TX (US); Joseph Merle Ditz, Houston, TX (US); Parijat Mishra, Sugarland, TX (US)

(73) Assignees: KELLOG BROWN & ROOT LLC, Houston, TX (US); YANBU ARAMCO SINOPEC REFINING CO., LTD., Yanbu, Industrial ( * ) Notice: Subject to any disclaimer, the term of this patent is extended or adjusted under 35 U.S.C. 154(b) by 265 days.

(21) Appl. No.: 15/209,336

(22) Filed: Jul. 13, 2016

(65) Prior Publication Data

US 2017/0015910 A1 Jan. 19, 2017

Related U.S. Application Data

(60) Provisional application No. 62/192,132, filed on Jul. 14, 2015.

(51) Int. Cl.
*C10B 57/02* (2006.01)
*C10B 55/00* (2006.01)

(52) U.S. Cl.
CPC ..... *C10B 57/02* (2013.01); *C10B 55/00* (2013.01)

(58) Field of Classification Search
CPC ..... C10B 55/00; C10B 57/02
See application file for complete search history.

(56) References Cited

U.S. PATENT DOCUMENTS

| | | | | |
|---|---|---|---|---|
| 3,471,761 | A | 10/1969 | Cameron | |
| 3,472,761 | A * | 10/1969 | Cameron | C10B 55/00 208/131 |
| 3,617,515 | A | 11/1971 | Bloomer | |
| 4,518,486 | A | 5/1985 | Jansma | |
| 4,894,144 | A * | 1/1990 | Newman | C10B 55/00 208/131 |
| 4,919,793 | A | 4/1990 | Mallari | |
| 6,332,975 | B1 | 12/2001 | Abdel-Halim et al. | |

* cited by examiner

*Primary Examiner* — Youngsul Jeong
*Assistant Examiner* — Gabriel E Gitman
(74) *Attorney, Agent, or Firm* — Gary Machetta

(57) ABSTRACT

Co-production a product anode grade coke and a product fuel grade coke is done using a system configured to implement a method that includes: directing an anode grade coker charge material from a tower to a first coke drum set; generating the product anode grade coke using the first coke drum set while directing a first vapor stream from the first coker drum set to the tower; directing a fuel grade coker charge material from a fractionator to a second coke drum set; generating the product fuel grade coke using the second coke drum set while directing a second vapor stream from the second coke drum set to the fractionator; and directing a third vapor stream from the tower to the fractionator while generating the product anode grade coke using the first coke drum set and generating the product fuel grade coke using the second coke drum set.

15 Claims, 1 Drawing Sheet

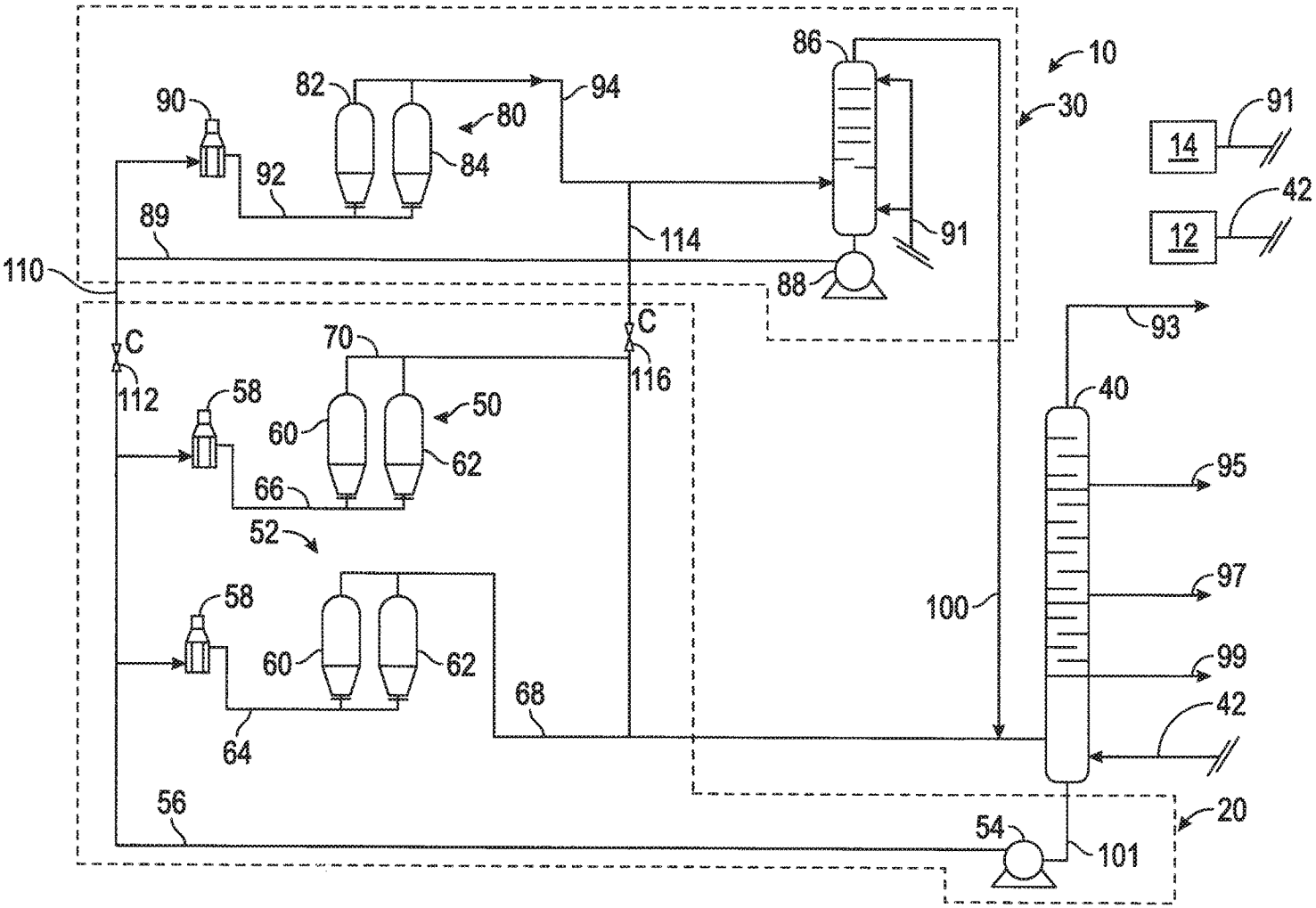
10
30
91
42
14
12
93
40
95
97
99
42
20
101
54
100
91
86
88
114
C
116
94
80
84
82
92
90
89
C
112
110
50
62
70
60
66
52
58
68
62
60
64
58
56

CO-PRODUCTION OF ANODE AND FUEL GRADE PETROLEUM COKE IN A DELAYED COKER UNIT

CROSS-REFERENCE TO RELATED APPLICATIONS

This application takes priority from provisional patent application No. 62/192,132, filed: Jul. 14, 2015, and titled, "Co-Production of Anode and Fuel Grade petroleum coke in a Delayed Coker Unit," the contents of which are incorporated by reference for all purposes.

BACKGROUND

1. Field of the Disclosure

The present disclosure generally relates co-producing two different grades of coke. In certain aspects, the disclosure is directed to co-producing anode grade and fuel grade coke.

2. Description of the Related Art

There are several grades of coke used in industry. The predominant grades are fuel grade and anode grade. Systems and related methods for producing various grades of coke are known in the art. For instance, U.S. Pat. Nos. 4,919,793 and 6,332,975, the disclosures of which are incorporated for all purposes, describe processes related to delayed coking and anode grade coke production, respectively. The present disclosure addresses the continuing need for enhanced coke production.

SUMMARY

In aspects, the present disclosure provides processes and related systems for the co-production of fuel grade and anode grade coke. These processes may use two separate and different liquid feeds: an anode grade coke feed and a fuel grade coke feed. These two liquid feeds may be handled in two separate processors: an anode coker feed tower and a fractionator, respectively. The anode coker feed tower receives product vapors from only the drums making the product anode grade coke. However, the fractionator combines the product vapors from the coke drums making product anode grade coke and the drums making product fuel grade coke to produce a fresh and recycled fuel grade feed and various coker products such as coker off-gas, coker LPG, coker naphtha, coker diesel, coker heavy gas oil, etc.

The source that provides the feed for the anode grade coking section may include a complete redundant feed supply and preparation facility to ensure the availability of the feed for the anode grade coking section. Also, the anode grade and fuel grade coke section may each have a dedicated coke handling system or share a common coke handling system.

One non-limiting method according to the present disclosure includes the steps of: directing an anode grade coker charge material from a tower to a first coke drum set; generating a product anode grade coke using the first coke drum set while directing a first vapor stream from the first coke drum set to the tower; directing a fuel grade coker charge material from a fractionator to a second coke drum set; generating a product fuel grade coke using the second coke drum set while directing a second vapor stream from the second coke drum set to the fractionator; and directing vapor a stream from the tower to the fractionator while generating the product anode grade coke using the first coke drum set and generating the product fuel grade coke using the second coke drum set.

In further aspects, the present disclosure provides a system for co-production a product anode grade coke and a product fuel grade coke. The system may include a tower, a first coke drum set, a fractionator, and a second coke drum set. The first coke drum set receives an anode grade coker charge material from the tower and is configured to generate the product anode grade coke while directing a first vapor stream to the tower. The second drum set receives a fuel grade coker charge material from the fractionator and is configured to generate the product fuel grade coke while directing a second vapor stream to the fractionator. The tower is configured to direct a third vapor stream to the fractionator while the first drum set generates the product anode grade coke and while the second coke drum set generates the product fuel grade coke.

It should be understood that examples of certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein:

The Figure depicts a system for co-production of fuel grade and anode grade coke according to one embodiment of the present disclosure.

DETAILED DESCRIPTION

Referring to FIG. 1, there is shown a system 10 for the co-production of fuel grade and anode grade coke. In the non-limiting embodiment shown, the system 10 includes a fuel grade coking section 20, an anode grade coking section 30, and a common fractionator 40. The system 10 enables anode grade and fuel grade coke to be produced simultaneously by using the shared fractionator 40.

During operation, the fractionator 40 receives the vapors from the fuel grade coking section 20, the vapors from the anode grade coking section 30, and a raw fuel grade vacuum residue (VR) feed 42. The VR feed 42 may have relatively high levels of impurities, such as sulfur and metals and be from a source 12, e.g., a vacuum distillation unit. The products of the fractionator 40 include overhead vapor (coker gas and coker naphtha) 93, light coker gas oil (LCGO) 95, heavy coker gas oil (HCGO) 97, heavier HCGO (HHCGO) outputs 99, and bottoms liquids that comprise a recycled and raw fuel grade feed (hereafter "fuel grade coker charge material") 101.

In one embodiment, the fuel grade coking section 20 includes two coke drum sets 50, 52 that are fed the fuel grade coker charge material by a common charge pump 54 via a line 56. Each coke drum set 50, 52 includes a pair of coke drums 60, 62, each of which is connected to an associated heater 58 via lines 64, 66, respectively. The coke drums 60, 62 are configured for a conventional batch operation wherein solidified product fuel grade coke is removed from one drum while cracking, condensation and phase separation occurs in the other drum. Vapor streams from the coke drum sets 50, 52 are passed to the fractionator 40 via lines 68, 70, respectively.

In one embodiment, the anode grade coking section 30 includes a coke drum set 80, a tower 86, a charge pump 88, and a coker heater 90. Liquid bottoms from the tower 86, which include recycled and raw anode grade feed (hereafter "anode grade coker charge material"), is pressurized and pumped by the charge pump 88 to the coker heater 90 via a line 89. The coker heater 90 feeds the anode grade coker charge material to the coke drum set 80 via a line 92. In one arrangement, the coke drum set 80 includes a pair of coke drums 82, 84 that generate product anode grade coke in a conventional batch operation. The coke drum set 80 further includes a line 94 that conveys a vapor stream from the drum set 80 to the tower 86.

The tower 86 enables the separation of two feeds to allow the co-production of fuel grade and anode grade coke. In one arrangement, the tower 86 receives an anode grade vacuum residue (VR) feed 91 from a source 14 and generates product streams that include an overhead vapor and liquid bottoms, which is the anode grade coker charge material. The anode grade VR feed 91 has lower impurities than the fuel grade VR feed 42. The lower impurities may be due to the use of an additional processing step such as hydrotreating to remove impurities or the source 14 processing a different crude oil than the source 12. The overhead vapors from the tower 86 are conveyed to the fractionator 40 via a line 100.

In certain arrangements, the source 14, which provides the feed for the anode grade coking section 30, may include a complete redundant feed supply and preparation facility. To ensure the availability of the feed for the anode grade coking section 30, such a facility may include a suitable import, storage, and heating system; a second crude distillation unit (CDU) or a second vacuum distillation unit (VDU) for processing low sulfur low metal feed; and/or a residue treating unit.

Various arrangements may be used for coke handling during operation of the system 10 and transport of the produced coke products. Conventionally, coke handling systems include sluices, railcars, cranes, and other like conveyance mechanisms. In some arrangements, each section 20, 30, may have a dedicated coke handling system that can operate independently of one another. In other arrangements, the sections 20, 30 may share a common coke handling system. Considerations such as the need for parallel operations may dictate which arrangement is suitable.

In an exemplary mode of operation, the system 10 simultaneously receives two separate coke feeds 42, 91 having different levels of impurities from two separate sources 12, 14, respectively. The fuel grade coke feed 42 is directed into the fractionator 40 and the anode grade coke feed 91 is directed into the tower 86.

The fuel grade coker charge material 101 from the fractionator 40 is pressurized to about 350 to 550 PSIG by the charge pump 54 and passed to coke heaters 58 via the line 56. After being heated to about 920-950 degrees F., the fuel grade coker charge material is passed to appropriate drums of the drum set 50, 52. Thereafter, product fuel grade coke is generated in a conventional batch process while a product vapor stream is directed back to the fractionator 40 via lines 68, 70.

In a largely similar and concurrent process, the anode grade coker charge material from the tower 86 is pressurized to about 350 to 550 PSIG by the charge pump 88 and passed to coke heater 90 via the line 89. After being heated to about 920-950 degrees F., the anode grade coker charge material is passed to appropriate drum of the drum set 80. Thereafter, product anode grade coke is generated in a conventional batch process while product vapors are directed back to the tower 86 via the line 94. The overhead vapors from the tower 86 flow to the fractionator 40 via line 100. Thus, the fractionator 40 simultaneously receives vapor from the fuel grade coke section 20 and the anode grade coke section 30.

In some variants, systems according to the present disclosure may be switched from simultaneous production of fuel grade coke and anode grade coke to production of only fuel grade coke. For instance, a line 110 and associated isolation valve 112 may be used to selectively connect the feed line 56 with feed line 89. Additionally, a line 114 and associated isolation valve 116 may be used to selectively connect the vapor line 70 with the vapor line 94. During co-production, the isolation valves 112, 116 are set to block flow and thereby isolate the fuel grade coke section 20 from the anode grade coke section 30. To produce only fuel grade coke, the isolation valves 112, 116 are opened. Thus, the anode grade coke section 30 receives the fuel grade raw feed via line 110 and the vapors from the drum set 80 are passed directly to the fractionator 40 via line 114. In this configuration, only fuel grade coke is generated. Also, only one coke feed, the fuel grade VR feed 42, is used. The anode grade VR feed 91 is terminated.

It should be noted that the teachings of the present disclosure are not limited to only the described embodiments. For example, the number of drum sets and the number of individual drums within each drum set may be modified as desired. Also, in some applications, an anode grade coke is a coke with a sponge structure having a sulfur level between 0.5-4.0%, vanadium level of 50-300 ppm, and nickel level of 50-200 ppm and a fuel grade coke is a coke that has sulfur, vanadium, and/or nickel not in such ranges. More generally, a fuel grade coke has measurably more impurities than an anode grade coke.

From the above, it should be appreciated that what has been disclosed includes a method of co-production a product anode grade coke and a product fuel grade coke. The method may include directing an anode grade coker charge material from a tower to a first coke drum set; generating the product anode grade coke using the first coker drum set while directing a first vapor stream from the first coke drum set to the tower; directing a fuel grade coker charge material from a fractionator to a second coke drum set; generating the product fuel grade coke using the second coke drum set while directing a second vapor stream from the second coker drum set to the fractionator; and directing a third vapor stream from the tower to the fractionator while generating the product anode grade coke using the first coke drum set and while generating the product fuel grade coke using the second coke drum set.

The method may also include steps such as pressurizing and heating the anode grade coker charge material being directed to the first coke drum set, directing an anode grade vacuum residue feed into the tower; pressurizing and heating the anode grade coker charge material being directed to the second coke drum set; directing a fuel grade coke feed into the fractionator; and/or directing an anode grade vacuum residue feed from a first source into the tower while simultaneously directing a fuel grade coke feed from a second source into the fractionator, wherein anode grade vacuum residue feed and the fuel grade coke feed have different levels of impurities. The product anode grade coke and/or the product fuel grade coke may be generated using a batch operation.

The method may also include terminating an anode grade vacuum residue feed into the tower; directing a fuel grade coke feed to the first and the second coke drum set; and generating the product fuel grade coke using the first coker drum set while directing the first vapor stream from the first coke drum set to the fractionator.

From the above, it should be also appreciated that what has been disclosed includes a system for co-production a product anode grade coke and a product fuel grade coke. The system may include a tower; a first coke drum set receiving an anode grade coker charge material from the tower, the first coke drum set being configured to generate the product anode grade coke while directing a first vapor stream to the tower; a fractionator; and a second drum set receiving a fuel grade coker charge material from the fractionator, the second drum set being configured to generate the product fuel grade coke while directing a second vapor stream to the fractionator. The tower may be configured to direct a third vapor stream to the fractionator while the first drum set generates the product anode grade coke and while the second coke drum set generates the product fuel grade coke.

The system may also include a serially arranged first pump and first heater pressurizing and heating the anode grade coker charge material being directed to the first coke drum set; a serially arranged second pump and second heater pressurizing and heating the fuel grade coker charge material being directed to the second coke drum set; a first source directing an anode grade vacuum residue feed into the tower; and/or a second source directing a fuel grade coke feed into the fractionator. The first source and the second source ma be configured for simultaneous operation. The first drum set and/or the second drum set may be configured for batch operation.

The system may also include a first line selectively directing a fuel grade coke feed to the first and the second coke drum set; and a second line selectively directing the first vapor stream from the first coke drum set to the fractionator while generating the product fuel grade coke using the first coker drum set.

While the foregoing is directed to embodiments of the present disclosure, other and further embodiments of the disclosure may be devised without departing from the basic scope thereof, and the scope thereof is determined by the claims that follow.

What is claimed is:

1. A system for co-production a product anode grade coke and a product fuel grade coke, comprising:

a tower;

a first coke drum set receiving an anode grade coker charge material from the tower, the first coke drum set being configured to generate the product anode grade coke while directing a first vapor stream to the tower;

a fractionator; and a second coke drum set receiving a fuel grade coker charge material from the fractionator, the second drum set being configured to generate the product fuel grade coke while directing a second vapor stream to the fractionator, wherein the tower is configured to direct a third vapor stream to the fractionator while the first drum set generates the product anode grade coke and while the second coke drum set generates the product fuel grade coke.

2. The system of claim 1, further comprising:

a serially arranged first pump and first heater pressurizing and heating the anode grade coker charge material being directed to the first coke drum set; and a serially arranged second pump and second heater pressurizing and heating the fuel grade coker charge material being directed to the second coke drum set.

3. The system of claim 1, further comprising:

a first source directing an anode grade vacuum residue feed into the tower; and a second source directing a fuel grade coke feed into the fractionator.

4. The system of claim 3, wherein the first source and the second source are configured for simultaneous operation.

5. The system of claim 1, wherein the first drum set and the second drum set are configured for batch operation.

6. The system of claim 1, further comprising:

a first line selectively directing a fuel grade coke feed to the first and the second coke drum set; and a second line selectively directing the first vapor stream from the first coke drum set to the fractionator while using the first coker drum set to generate the product fuel grade coke.

7. A method of co-generating a product anode grade coke and a product fuel grade coke, comprising:

directing an anode grade coker charge material from a tower to a first coke drum set;

generating the product anode grade coke using the first coker drum set while directing a first vapor stream from the first coke drum set to the tower;

directing a fuel grade coker charge material from a fractionator to a second coke drum set;

generating the product fuel grade coke using the second coke drum set while directing a second vapor stream from the second coker drum set to the fractionator; and directing a third vapor stream from the tower to the fractionator while generating the product anode grade coke using the first coke drum set and while generating the product fuel grade coke using the second coke drum set.

8. The method of claim 7, further comprising:

pressurizing and heating the anode grade coker charge material being directed to the first coke drum set.

9. The method of claim 7, wherein the product anode grade coke is generated using a batch operation.

10. The method of claim 7, further comprising:

directing an anode grade vacuum residue feed into the tower.

11. The method of claim 7, further comprising:

pressurizing and heating the anode grade coker charge material being directed to the second coke drum set.

12. The method of claim 7, wherein the product fuel grade coke is generated using a batch operation.

13. The method of claim 7, further comprising:

directing a fuel grade coke feed into the fractionator.

14. The method of claim 7, further comprising:

directing an anode grade vacuum residue feed from a first source into the tower while simultaneously directing a fuel grade coke feed from a second source into the fractionator, wherein the anode grade vacuum residue feed and the fuel grade coke feed have different levels of impurities.

15. The method of claim 7, further comprising:

terminating an anode grade vacuum residue feed into the tower;

directing the fuel grade coke feed to the first and the second coke drum set; and generating the product fuel grade coke using the first coker drum set while directing the first vapor stream from the first coke drum set to the fractionator.

* * * * *